US010475436B2

(12) United States Patent
Lachot et al.

(10) Patent No.: US 10,475,436 B2
(45) Date of Patent: Nov. 12, 2019

(54) HEXAGONAL 2-DIMENSIONAL REFLECTION PHASE GRATING DIFFUSER

(71) Applicant: OVERDUB LANE INC., Chapel Hill, NC (US)

(72) Inventors: Wesley Dean Lachot, Chapel Hill, NC (US); Peter D'Antonio, Bowie, MD (US)

( * ) Notice: Subject to any disclaimer, the term of this patent is extended or adjusted under 35 U.S.C. 154(b) by 67 days.

(21) Appl. No.: 15/858,029

(22) Filed: Dec. 29, 2017

(65) Prior Publication Data

US 2019/0206383 A1 Jul. 4, 2019

(51) Int. Cl.
*G10K 11/28* (2006.01)

(52) U.S. Cl.
CPC ..... *G10K 11/28* (2013.01)

(58) Field of Classification Search
CPC ..... G10K 11/28
USPC ..... 181/293
See application file for complete search history.

(56) References Cited

U.S. PATENT DOCUMENTS 3,232,371 A * 2/1966 Reichert ..... B41J 29/08 181/293
4,821,839 A * 4/1989 D'Antonio ..... E04B 1/86 181/198
5,401,921 A * 3/1995 D'Antonio ..... G10K 11/20 181/286
5,817,992 A * 10/1998 D'Antonio ..... E04B 1/8409 181/295
6,112,852 A * 9/2000 D'Antonio ..... G10K 11/20 181/295
6,609,592 B2 * 8/2003 Wilson ..... B32B 3/20 181/292
6,772,859 B2 * 8/2004 D'Antonio ..... E04B 1/84 181/293
7,314,114 B2 * 1/2008 Gardner ..... E04B 1/86 181/284
7,428,948 B2 * 9/2008 D'Antonio ..... E04B 1/86 181/292
7,604,094 B2 * 10/2009 Magyari ..... G10K 11/20 181/286
9,761,216 B2 * 9/2017 Nampy ..... G10K 11/172
2003/0006092 A1 * 1/2003 D'Antonio ..... E04B 1/86 181/293
2004/0060771 A1 * 4/2004 D'Antonio ..... E04B 1/84 181/293
2005/0173187 A1 * 8/2005 Gardner ..... E04B 1/86 181/293
2005/0194210 A1 * 9/2005 Panossian ..... B32B 3/12 181/293
2006/0231331 A1 * 10/2006 D'Antonio ..... E04B 1/86 181/293
2007/0034448 A1 * 2/2007 D'Antonio ..... E04B 1/86 181/293

(Continued)

*Primary Examiner* — Forrest M Phillips
(74) *Attorney, Agent, or Firm* — H. Jay Spiegel

(57) ABSTRACT

A hexagonal two-dimensional reflection phase grating diffuser includes a plurality of wells that are either part hexagonal or fully hexagonal in cross-section. The depths of the respective wells are determined through calculation of a number theory sequence such as a quadratic residue number theory sequence, a primitive root sequence, or a Chinese remainder theorem. The diffuser may be located within a listening room oriented with openings in the wells facing either downward or horizontally.

20 Claims, 10 Drawing Sheets

(56) References Cited

U.S. PATENT DOCUMENTS

| | | | | |
|---|---|---|---|---|
| 2009/0038883 | A1* | 2/2009 | Kim | E04B 1/86 181/291 |
| 2014/0339015 | A1* | 11/2014 | Algargoosh | G10K 11/16 181/293 |
| 2017/0229106 | A1* | 8/2017 | Nampy | G10K 11/172 |

* cited by examiner

HEXAGONAL 2-DIMENSIONAL REFLECTION PHASE GRATING DIFFUSER

BACKGROUND OF THE INVENTION

The present invention relates to a hexagonal 2-dimensional reflection phase grating diffuser. Sound diffusers described thus far in the patent literature have included single plane devices, for example, those disclosed in U.S. Pat. No. D291,601 to D'Antonio et al. and U.S. Pat. No. 4,821,839 to D'Antonio et al. They cause scattering into a hemi-disc, acting as a plane surface in the other directions. While this is the preferred diffuser design for some applications, there is a need for a diffuser that scatters into a hemisphere.

For a Schroeder diffuser this can be achieved by forming a two-plane device, often referred to as a 2D diffuser. This device scatters optimally in the x- and z-direction, and therefore gives even lobes on a hemisphere. Examples include U.S. Pat. No. D306,764 to D'Antonio et al., U.S. Pat. No. 5,401,921 to D'Antonio et al., and U.S. Pat. No. 5,817,992 to D'Antonio. All of these devices have been based on orthogonal designs, based on a rectangular grid. The teachings of this patent will describe a novel 2D diffuser, based on a hexagonal grid.

The present invention consists of a hexagonally shaped device consisting of wells made of smaller hexagonal shapes, and represents a significant step in the evolution of diffusing devices because it is better suited than existing devices for solving acoustical issues in certain types of architectural structures. The present invention includes significant improvements that are not available in currently available products.

For accurate stereo monitoring, it is important to establish a symmetrical listening triangle, two vertices of which are established by the theoretical point sources of the two monitors, and the third vertex being a point just behind the listener's head. The equilateral listening triangle is usually the most advantageous configuration since it provides an excellent balance between a wide stereo sound field and a stable center (or phantom) image.

In a well-designed control room, this listening triangle is one of the core elements that determines the interrelationships between all of the other elements of the room. This equilateral listening triangle, seen in FIG. 1, is made up of three sides, each representing an axis of symmetry rotated 120 degrees from the other two, and thus introduces an element of tri-axial rather than bi-axial layout into the control room plan.

The reflection free zone (RFZ) control room principle was first developed by Dr. Peter D'Antonio in 1983, for the purpose of creating the most accurate monitoring possible at the recording engineer's listening position. This is accomplished by eliminating early reflections at the engineer's position by angling the walls in such a way that all such reflections are channeled past the ends of the recording console and toward the back of the room. Any subsequent secondary reflections re-entering the engineer's sound field from the rear of an adequately sized RFZ control room are delayed by more than 20 ms, and usually scattered by rear wall diffusers, and are clearly perceived as ambience separate from the direct sound, rather than causing comb filtering as happens when specular reflections earlier than 20 ms are allowed to blend with the direct sound.

Comb filtering causes serious deterioration of perceived sound quality and makes it impossible for the engineer to reliably trust the frequency spectrum and sound quality of the music.

D'Antonio's plan of an RFZ control room was published on page 302 of The Master Handbook of Acoustics 2nd. ed. by F. A. Everest, TAB Books, 1989, and shows a configuration suggestive of a half-hexagon within the main three walls of the front of the control room, with the monitor soffits set symmetrically in the vertices of the 120 degree angles formed by those three walls. Since the 1980s, experience has shown the hexagonal configuration in the front of the room to be the most advantageous RFZ shape for a variety of room sizes, maximizing the size of the reflection free zone for the engineer, while using space economically. The front end of the room is where the hexagonal shape is most important, since the purposeful reflection of direct sound from the monitors takes place in the front of the room. The angles of rear side walls are less important from a reflection standpoint. Note that in addition to the listening triangle mentioned above, it is seen that another important element of a good monitoring room—the shape of the room itself—relies upon tri-axial rather than bi-axial layout.

SUMMARY OF THE INVENTION

The present invention relates to a hexagonal 2-dimensional reflection phase grating diffuser. The present invention, an example of which is shown in FIG. 2, was conceived after many years of designing RFZ control rooms and realizing that there is a need for ceiling-hung acoustic treatments (commonly referred to as clouds) that incorporate diffusing elements that are more appropriately shaped for the room itself. Hexagonally shaped diffusers deployed on the ceiling as part of a cloud system fit better into the plan of an RFZ control room than square or other rectilinear shapes, giving better diffusion coverage of the ceiling to floor dimension. This is because the shape of the diffuser is derived from the same three axes of symmetry as the shape of the room. In addition to their superior performance on ceiling cloud arrays, hexagonally shaped diffusers can be effectively used as wall treatments, offering the designer an attractive alternative to rectilinear shaped diffusers.

As such, it is a first object of the present invention to provide a hexagonal 2-dimensional reflection phase grating diffuser.

It is a further object of the present invention to utilize depths based on an optimal number theory sequence, like the quadratic residue sequence (QR), to provide sound diffusion over a broad specified range of frequencies.

It is a further object of the present invention to provide an attractive hexagonal array to introduce a highly pleasing and symmetrical architectural surface.

It is a further object of the present invention to unify the functional and the aesthetic properties of an RFZ control room throughout a series of different scales.

It is a further object of the present invention to provide such a diffuser that more effectively operates in a listening room where adjacent walls make angles of 120°.

These and other aspects of the present invention will be better understood from the following specific description of the preferred embodiments when read in conjunction with the appended drawing figures.

SPECIFIC DESCRIPTION OF THE PREFERRED EMBODIMENTS

Figure 4:
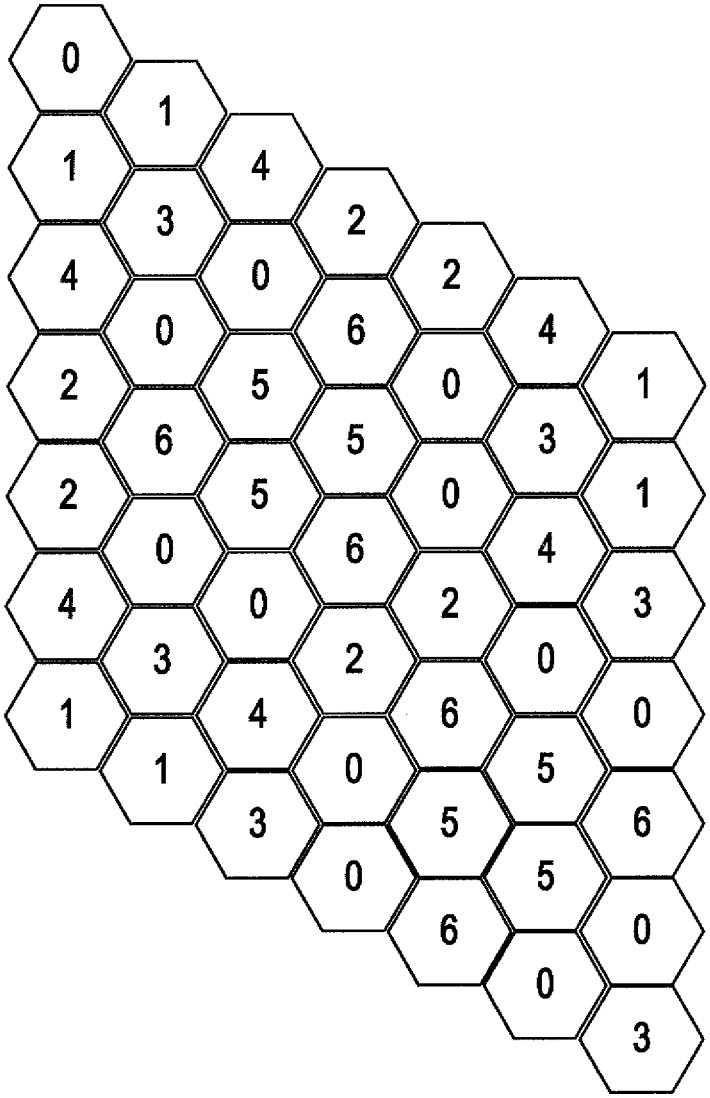
FIG. 4 shows a schematic representation of a hexagonal unit diffuser cell based on a quadratic residue diffuser with prime number 7.

The preset invention relates to a new reflection phase grating diffuser consisting of divided hexagonal wells whose depth is based on a chosen number theoretic design. The number of hexagonal elements in a given design will depend on a chosen prime number. For example, utilizing a quadratic residue number theory sequence with prime number 7, the base unit will contain 49 divided hexagonal cells, designed using the Chinese Remainder Theorem as shown in FIG. 4.

Since 2D diffusers scatter in multiple planes, a receiver in the bright zone will experience a scattered energy that is attenuated more than for a 1D diffuser (provided multiple grating lobes are present). The number of grating lobes is squared if a 1D of width Nw and 2D diffuser of size Nw×Nw are compared, where N is a prime and w is the width of one of the elements in the unit cell. Therefore, the energy in each lobe will reduce by 10 $\log_{10}(m)$, where m is the number of grating lobes present for the 1D diffuser.

There are two common processes for forming 2D diffusers. The first involves forming two sequences, one for the x-direction, one for the z-direction and amplitude modulating the x sequence with the z sequence. For a quadratic residue sequence, this can be expressed as:

$$s_{n,m}=(n^2+m^2)\text{modulo } N \quad (1)$$

where n and m are integers and index the sequence for the $n^{th}$ and $m^{th}$ wells in the x- and z-directions respectively. A similar procedure can be used for primitive root diffusers:

$$s_{n,m}=(r^n+r^m)\text{modulo } N \quad (2)$$

It is even possible to have a quadratic residue sequence in one direction and a primitive root sequence in the other, provided they are based on the same prime number, although it is hard to see why you would chose to do this.

Figure 5:
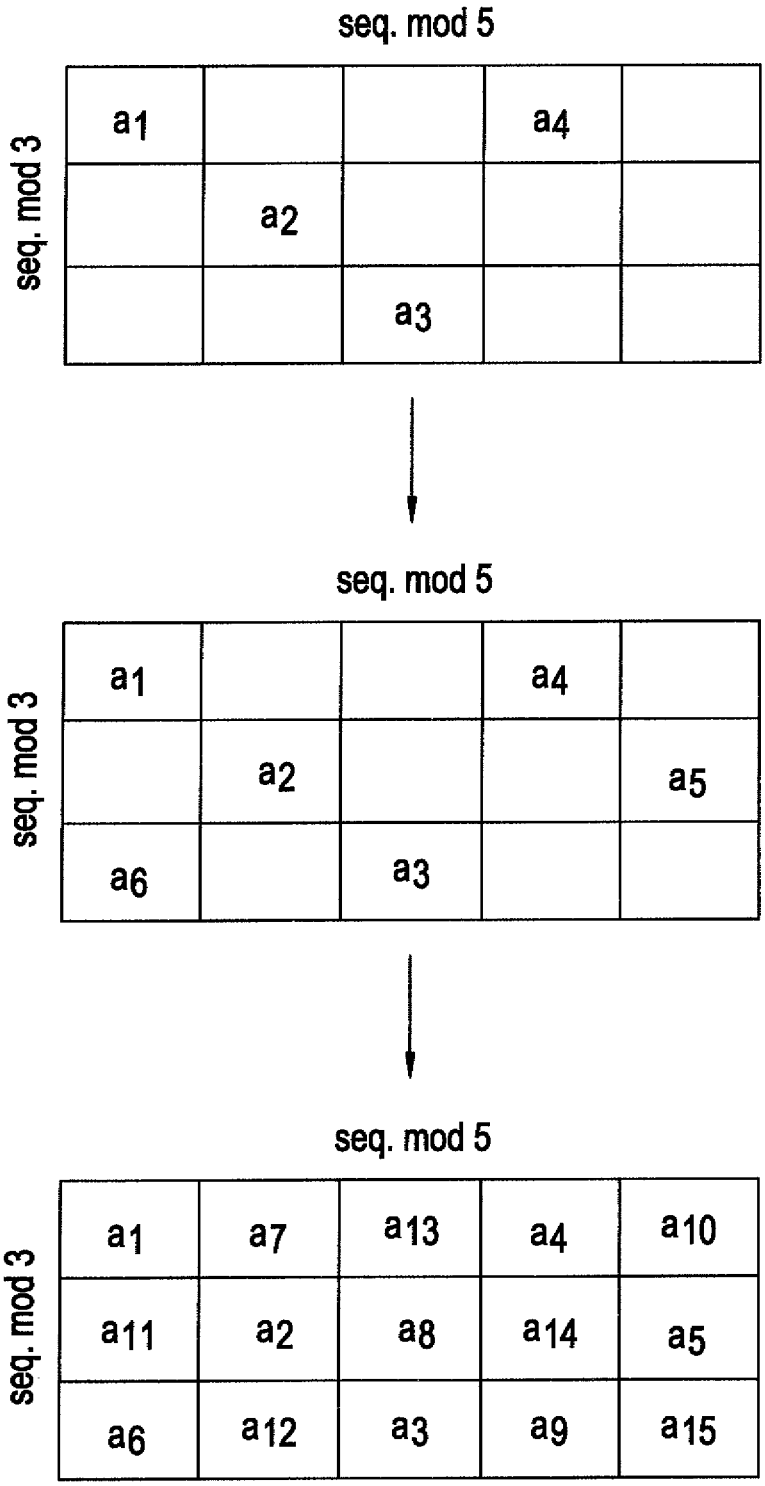
FIG. 5 shows some of the mathematical steps involved in folding a length 15 sequence a1 . . . a15 into a 2D array, using the Chinese remainder theorem.

The second method for making multi-dimensional diffusers is to use the Chinese remainder theorem. This folds a 1D sequence into a 2D array while preserving the Fourier properties of the 1D sequence. The process is described in detail in FIG. 5.

The requirement for co-prime factors means that this folding technique cannot be applied to single periods of QRDs, because there is a prime number of wells. This can be overcome by using an odd-number generator N for the quadratic residue sequence which is not prime. For example, a quadratic residue sequence based on N=15 will work perfectly well at the design frequency and can be wrapped into a 3×5 array. The problem is that the surface will have flat plate frequencies at 3 and 5 times the design frequency (as well as 6, 10, 9, 15 . . . times). Consequently, to use a non-prime N it is necessary to make sure the factors of N are sufficiently large that the flat plate frequency is above the frequency of interest. For example, N=143 has factors of 11 and 13 and so would be a good choice as the flat plate frequencies will be beyond the upper frequency limit of most diffusers. It is also possible to apply the Chinese remainder theorem to some primitive root and other mathematical sequences, such as the Chu sequence outlined previously.

It has also been suggested by D'Antonio and Konnert that the wrapping can be carried out in a hexagonal configuration (Equation (3):

$$s_{n,m}=(n^2+m^2+nm)\text{modulo } N \quad (3)$$

The reason the hexagonal shape works best for the diffuser wells is twofold. First, there is the practical matter that square wells would be awkward to arrange and aesthetically out of place within the larger tri-axial diffuser structure, leaving either small slivers of odd-shaped wells or areas of wasted surface without diffusive properties. Second, three axes of symmetry are better than one or two axes of symmetry for ceiling diffusers. Simple one-dimensional Schroeder diffusers can be quite effective when placed parallel to the rear wall plane in a control room, since most critical listening is done by sound engineers with their ears roughly 48" from the floor, and diffusion into a hemi-disc is all that is required for this application, from the standpoint of the engineer's ears. However, the requirements for effective ceiling diffusers are different, and fully hemispherical diffusion is the best solution for even sound distribution throughout the room—the more axes of diffusion the better for this purpose. This is true not just for control rooms but for music tracking rooms and other sound rooms as well.

Figure 1:
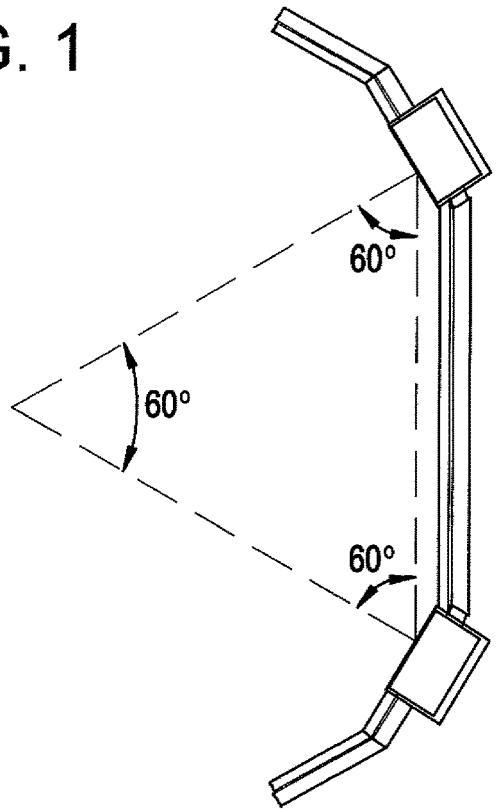
FIG. 1 shows an equilateral listening environment in a recording studio control room.
Figure 2:
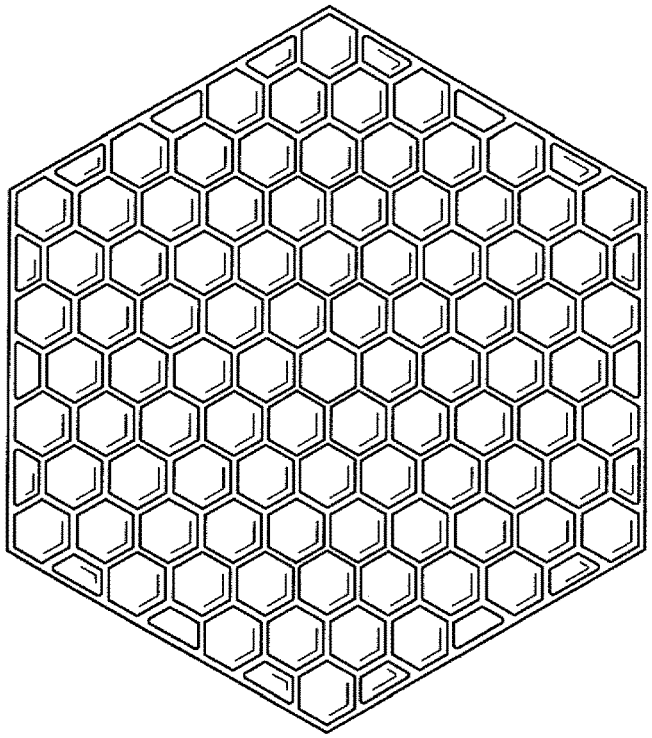
FIG. 2 shows an example of a diffuser according to the present invention.
Figure 3A:
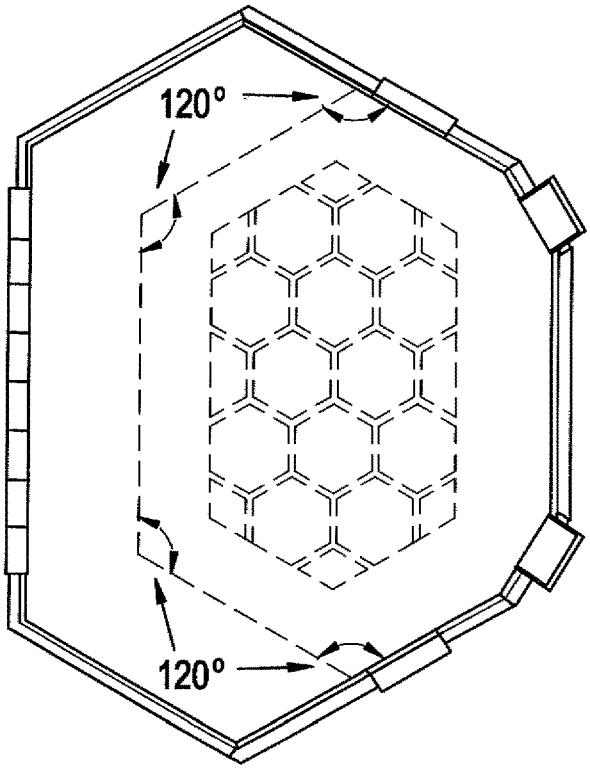
FIG. 3*a* shows a top view of an RFZ control room with hexagonal diffuser clouds.
Figure 3B:
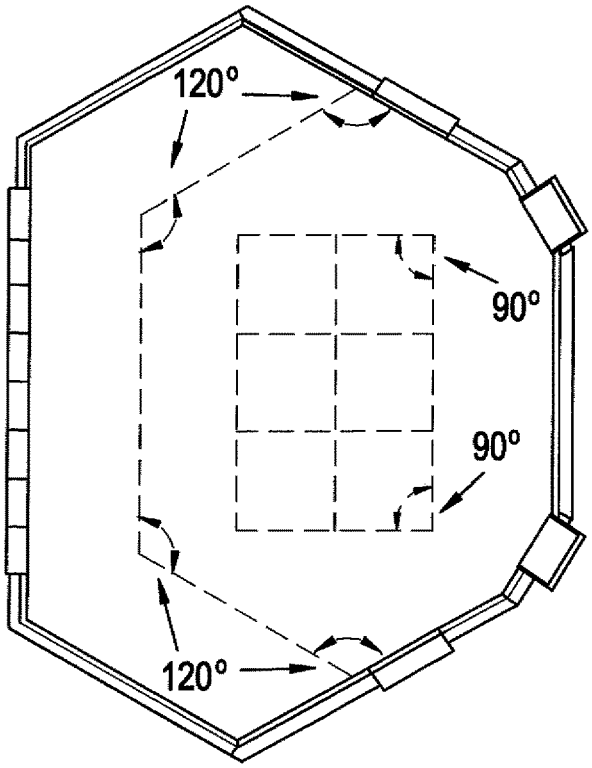
FIG. 3*b* shows a top view of an RFZ control room with rectilinear diffuser clouds.

FIG. 2 illustrates a hexagonal QRD based on N=7 generated using Equation (3). As clearly shown in FIG. 2 as well as FIGS. 3*a*, 4, 8*a*, 8*b*, 9 and 10, the hexagonal wells are contiguous with one another such that adjacent wells have common walls.

Figure 6A:
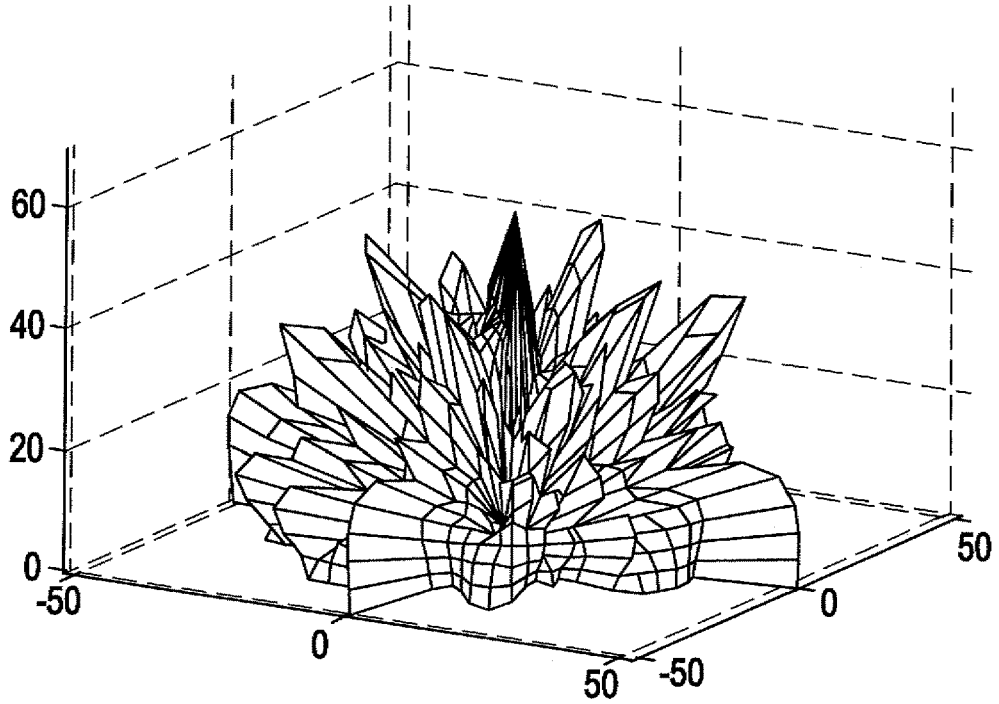
FIG. 6*a* shows scattering from an N=7×7 QRD at four times the design frequency.
Figure 6B:
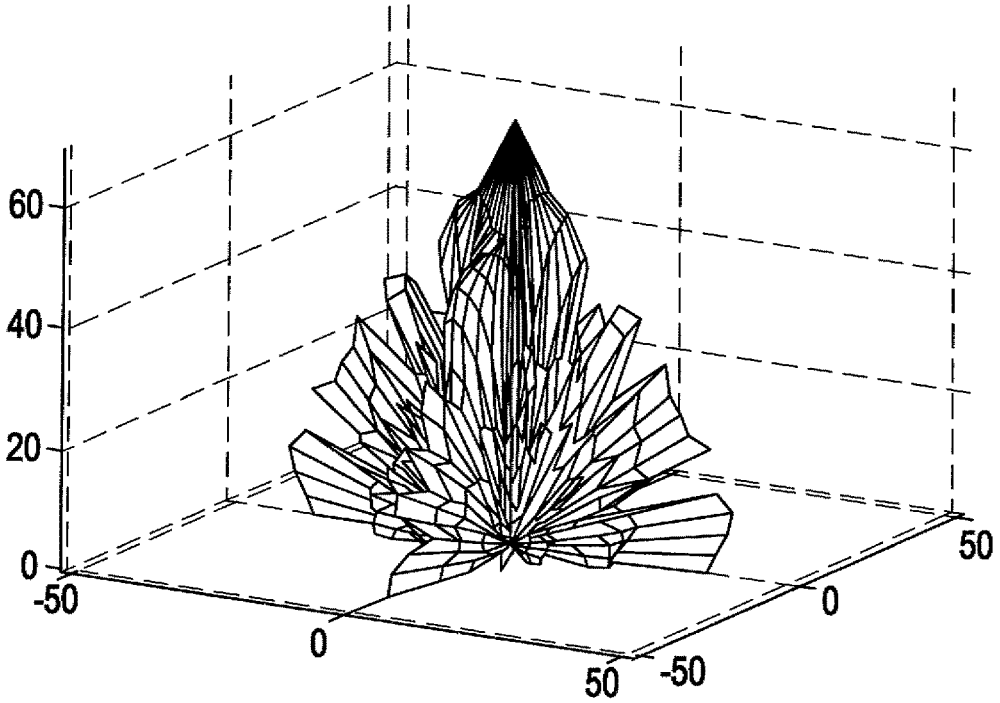
FIG. 6*b* shows scattering with respect to a plane surface.
Figure 7A:
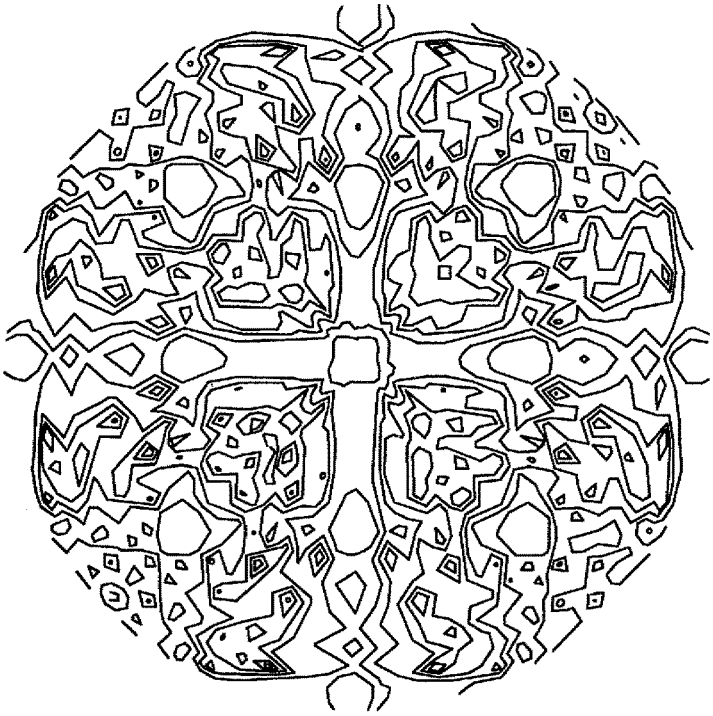
FIGS. 7*a* and 7*b* show contour plots of polar response shown in FIGS. 6*a* and 6*b* seen from above. The QRD (FIG. 7*a*) shows 13 grating lobes, where the 3×3 grid of lobes shown in the center is clearest. The plane surface (FIG. 7*b*) has just a lobe in the specular reflection direction.
Figure 7B:
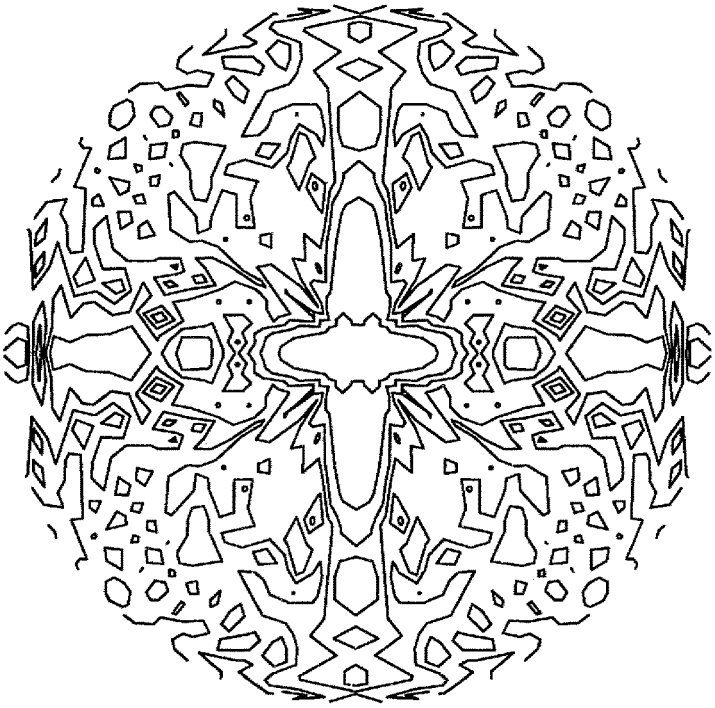

FIGS. 6*a* and 6*b* illustrate the scattering from a 2D N=7×7 QRD and a plane surface. There are a regular set of grating lobes, but these are difficult to see unless the polar response can be animated and rotated. FIGS. 7*a* and 7*b* show the data as a contour plot, where the grating lobes become more obvious. These grating lobes form a regular grid, the middle 9 in a 3×3 grid are most obvious in the case shown. These contour plots are effectively the contour on the surface of the hemisphere, looking down onto the hemisphere. Consequently, the x- and z-axes shown are non-linear.

The hexagonal diffuser incorporates a hexagonal quadratic residue sequence based on a Prime number 7 forming a hexagonal element, which can be used independently or periodically. The hexagonal QRD contains 49 hexagonal elements.

Figure 8A:
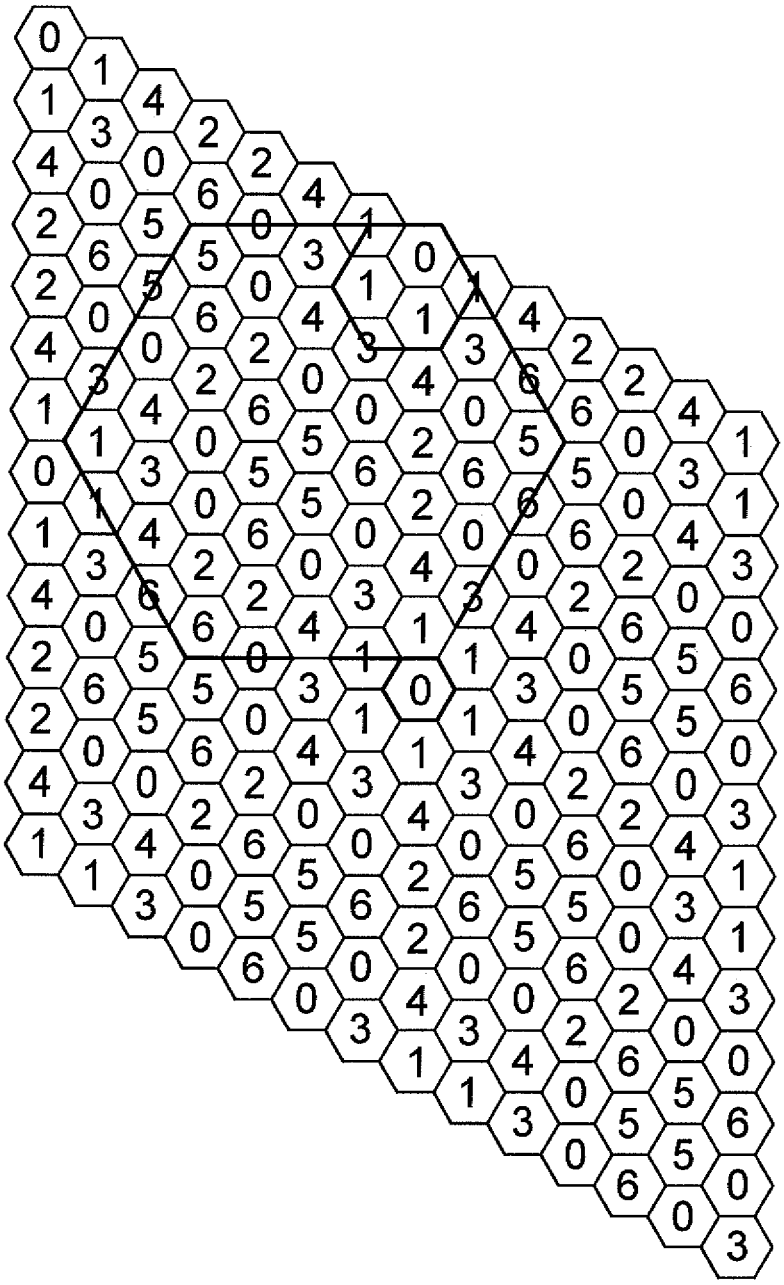
FIG. 8*a* shows a hexagon containing 49 sub-hexagonal units.
Figure 8B:
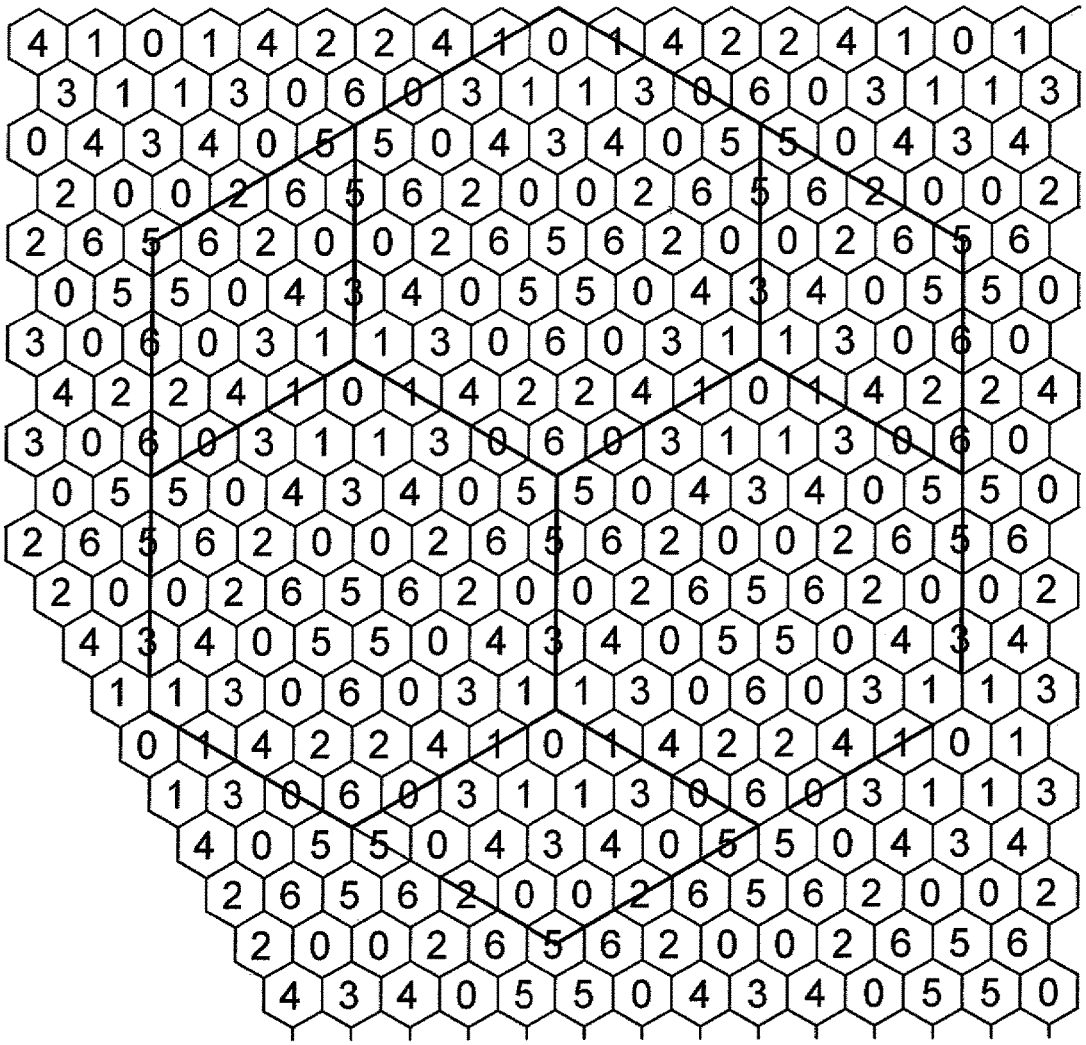
FIG. 8*b* shows a large hexagon containing (3) 49 unit hexagons and (3) ⅓ unit hexagons equaling 196 hexagonal sub-units.

The hexagonal diffuser outlined in FIG. 8*a* contains 43 complete hexagons and 12 half hexagons on the borders. 43+12/2=49. The design contains (13) zero depth hexagons and (6) depths 1, 2, 3, 4, 5 and 6. The diagonal, d, of a hexagon equals twice the side, s, dimension.

The tip-tip distance, D, of the full 49 element hexagonal array contains 5d and 4s or 14s. Therefore, if the overall diagonal D equals 44", then s=3.19" and d=6.29". This will be too large and result in specular high frequency reflections.

To overcome this, a larger array is suggested. The larger array outlined at FIG. 8*b*, as an example, contains 3 (49) element hexagons and (3) ⅓ element hexagons totaling (4) with 196 sub-hexagonal units.

In this larger (4) element hexagon, H, in this example containing a zero element, (2) 1 elements and (2) ⅓—1 elements and (1) ⅓—3 element, we have a major diagonal, DD, equal to 28s. Therefore, we can use this to determine the length of a side.

If s=2", DD=56"
If s=1.57", DD=44"
If s=1", DD=28"

Figure 9:
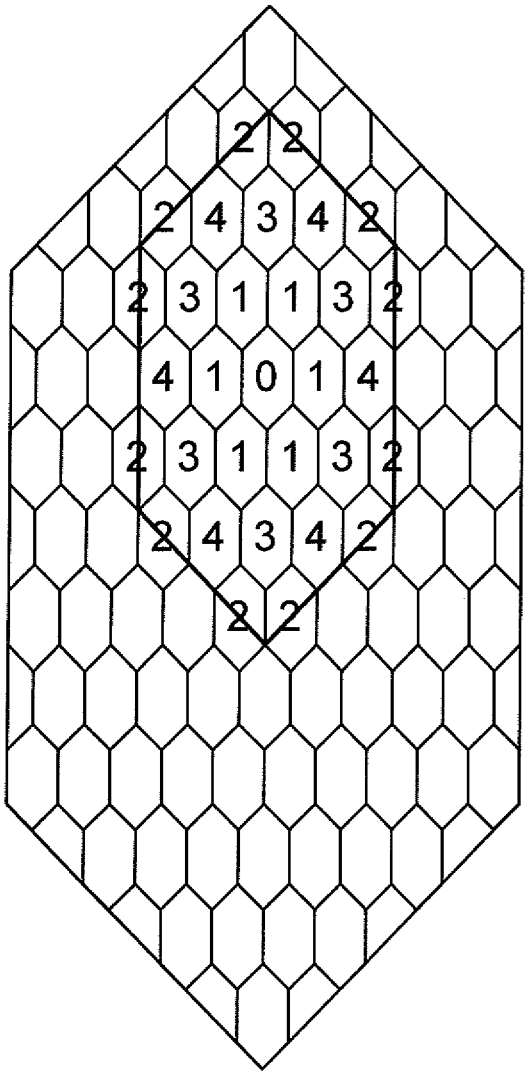
FIG. 9 shows a hexagon based on prime 5 and a large hexagon containing (3) 25 unit hexagons and (3) ⅓ unit hexagons, with a total of 100 sub-unit hexagons.
Figure 10:
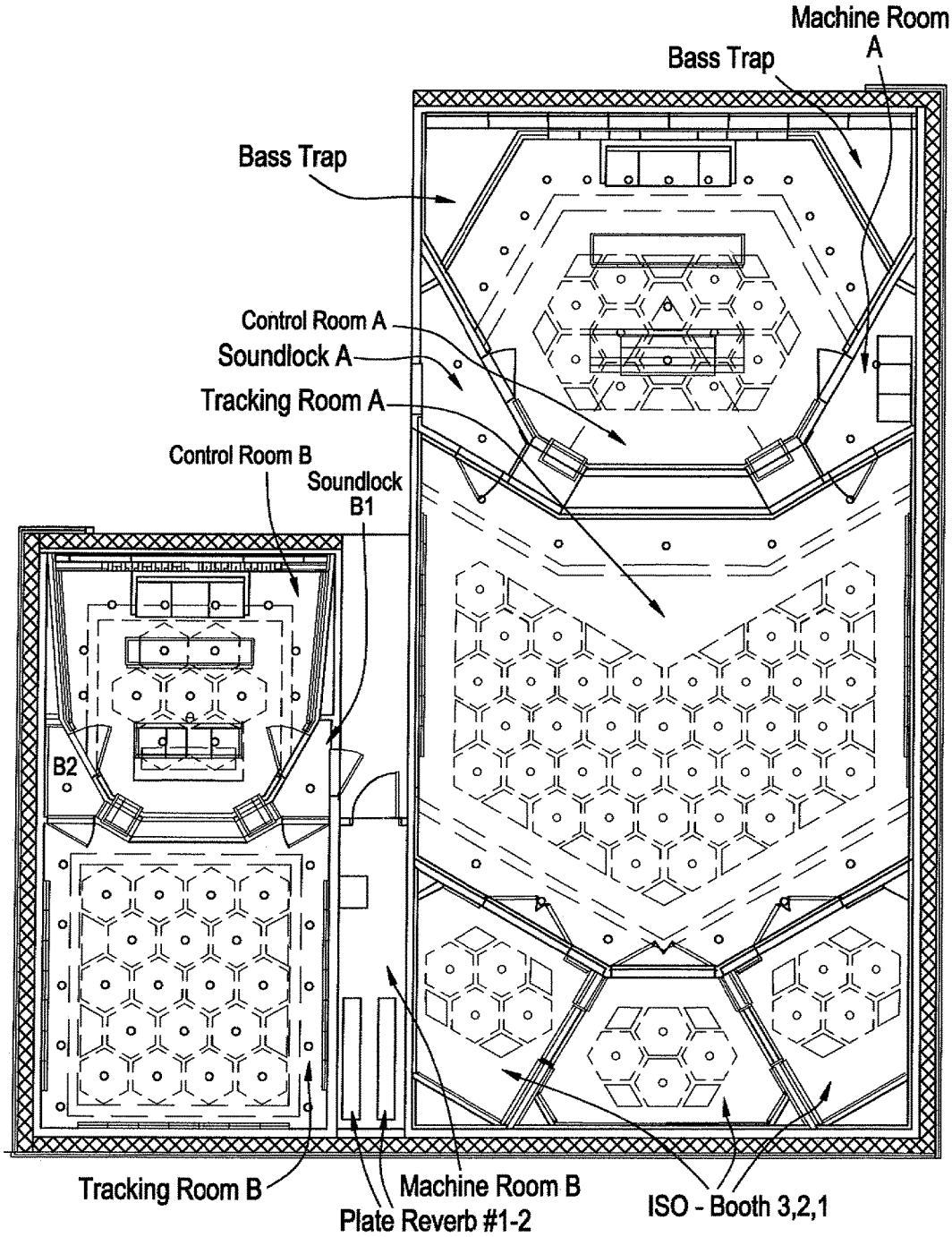
FIG. 10 shows application of the Hexaffusor cloud in a control room and live rooms of a proposed studio complex.

In some cases, a smaller repeat unit may be more practical and so we describe a prime 5 based hexagon with 25 sub-hexagonal units in FIG. 9. The larger hexagon containing a total of 4 hexagons will contain 100 sub-hexagonal units.

The hexagonal diffuser can be seen as an integral part of a four-tier fractal arrangement, with the smallest scale unit being the hexagonal diffuser well, the next largest scale unit being the hexagonal diffuser itself, the third largest scale unit being the diffuser array, and the largest unit being the room itself. Due to the nesting properties of these different scaled units, the overall practical and aesthetic effect is natural and organic, without needless wasted space, and most importantly without acoustically untreated areas.

These attractive and symmetrical hexagonal units can be arrayed in many architectural venues. An example is shown in a recording studio ceiling in FIG. 10.

Other potential uses include geodesic domes, which are known to be the most efficient physical structures yet invented. They are efficient both in terms of being capable of enclosing the largest volume of space per unit weight of structural material, and in terms of allowing for almost total freedom of layout and use of the interior space since they don't require intermediate structural support columns; the skin is the structure. For this reason, they have been used in remote areas of the planet where it is impractical to transport large amounts of building materials to the site, and they will surely be used extensively when humans begin to build structures on other planets. Given the importance of green and sustainable building practices, the use of more efficiently built structures is inevitable, and the geodesic dome is a very efficient type of habitable dwelling with a low carbon footprint.

However, geodesic domes are also known to have very poor acoustics. The very dome shape that makes them so strong structurally is also what makes them poor acoustically because the inside of the dome creates a lens effect that focuses sounds, causing strange cancellation effects that can make the human voice sound like that of a robot, among other anomalies.

To counteract the poor acoustical properties of the geodesic dome, a diffuser is provided that can attach to the problematic interior walls, and the type of diffuser that makes the most practical sense is one shaped similarly to the panels that make up the geodesic dome itself. One of the main types of shapes used to create domes is the hexagon. The hexagonal diffuser can easily be sized appropriately configured with mounting hardware so that it can be deployed on the interior surfaces of a geodesic dome. The hexagonal diffuser solves the sound focusing problem of the geodesic dome by introducing the antidote to sound focusing, which by definition is sound diffusion.

The other main type of geometric shape used to create domes is the equilateral triangle. This shape contains the same triaxial symmetry as the hexagon, and the hexagonal diffuser can be easily configured into this triangular shape while retaining aesthetic and functional integrity, since the hexagon and the triangle are such closely related geometric forms.

The superior aesthetic and functional qualities of the hexagonal diffuser are attributable to the relationship between its form and its function. This unique device is better able to the solve practical and acoustical issues of certain types of architectural structures than diffusers made in rectilinear or other existing configurations.

As such, an invention has been disclosed in terms of preferred embodiments thereof which fulfill each and every one of the objects of the invention as set forth herein above, and provide new and useful hexagonal sound diffusers of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

The invention claimed is:

1. A sound diffuser, comprising:

a) a surface defining openings of a plurality of wells;

b) depths of respective ones of said wells being determined by a number theory sequence based upon a prime number;

c) each well having a substantially uniform cross-section comprising at least a portion of a hexagon; and d) said wells being contiguous with one another such that adjacent wells have common walls, said sound diffuser diffusing sound waves that enter said wells.

2. The sound diffuser of claim 1, wherein said number theory sequence comprises a quadratic residue number theory sequence.

3. The sound diffuser of claim 2, wherein said prime number is 7.

4. The sound diffuser of claim 2, wherein said diffuser has 49 wells.

5. The sound diffuser of claim 1, wherein said diffuser has 49 wells.

6. The sound diffuser of claim 1, wherein said number theory sequence comprises a primitive root sequence.

7. The sound diffuser of claim 1, wherein some of said wells have hexagonal cross-sections and others of said wells have cross-sections comprising a fraction of a hexagon.

8. The sound diffuser of claim 7, wherein said fraction comprises ½.

9. The sound diffuser of claim 1, wherein said number theory sequence comprises a Chinese remainder theorem.

10. The sound diffuser of claim 1, mounted with said surface facing downward.

11. The sound diffuser of claim 1, mounted with said surface facing horizontally.

12. The sound diffuser of claim 4, mounted with said surface facing downward.

13. The sound diffuser of claim 7, comprising 43 hexagonal wells and 12 half-hexagonal wells.

14. The sound diffuser of claim 1, mounted within a geodesic dome.

15. The sound diffuser of claim 11, mounted within a geodesic dome.

16. A sound diffuser, comprising:

a) a surface defining openings of a plurality of wells;

b) depths of respective ones of said wells being determined by a number theory sequence based upon a prime number;

c) each well having a substantially uniform cross-section comprising at least a portion of a hexagon with at least some of said wells having hexagonal cross-sections and at least others of said wells having cross-sections comprising a fraction of a hexagon; and d) said wells being contiguous with one another such that adjacent wells have common walls, said sound diffuser diffusing sound waves that enter said wells.

17. The sound diffuser of claim 16, wherein said number theory sequence is chosen from the group consisting of a quadratic residue number theory sequence, a primitive root sequence, and a Chinese remainder theorem.

18. The sound diffuser of claim 16, wherein said prime number is 7 and said diffuser has 49 wells.

19. The sound diffuser of claim 16, wherein said fraction comprises ½.

20. The sound diffuser of claim 16, mounted with said surface facing either downward or horizontally.

* * * * *